US006378674B1

(12) United States Patent
Lee

(10) Patent No.: US 6,378,674 B1
(45) Date of Patent: Apr. 30, 2002

(54) ARRESTING MEMBERS OF AN EXPANDABLE PULL ROD OF LUGGAGE

(75) Inventor: Yu-Wen Lee, Chang Hua Hsien (TW)

(73) Assignee: Hando Industrial Co., Ltd., Chang Hua Hsien (TW)

( * ) Notice: Subject to any disclaimer, the term of this patent is extended or adjusted under 35 U.S.C. 154(b) by 0 days.

(21) Appl. No.: 09/828,665

(22) Filed: Apr. 9, 2001

(51) Int. Cl.[7] ..... A45C 13/00
(52) U.S. Cl. ..... 190/115; 16/113.1
(58) Field of Search ..... 16/113.1; 190/115; 280/37, 47.315

(56) References Cited

U.S. PATENT DOCUMENTS 6,026,543 A * 2/2000 Chen ..... 16/113.1
6,141,828 A * 11/2000 Kuo ..... 16/113.1
6,148,477 A * 11/2000 Cheng ..... 16/113.1
6,161,253 A * 12/2000 Tu ..... 16/113.1

* cited by examiner

*Primary Examiner*—Stephen P. Garbe
*Assistant Examiner*—Tri M. Mai
(74) *Attorney, Agent, or Firm*—Harrison & Egbert

(57) ABSTRACT

An expandable pull rod frame of the luggage includes a first arresting member and a second arresting member, which are adapted to a two-segmented, three-segmented, or four-segmented pull rod frame. The arresting members are provided with the locating bodies, the guide edges, and the inclined holes for guiding the locating bodies, thereby resulting in a precision adjustment in length of the expandable pull rod.

1 Claim, 11 Drawing Sheets

ARRESTING MEMBERS OF AN EXPANDABLE PULL ROD OF LUGGAGE

BACKGROUND OF THE INVENTION

1. Field of the Invention

The present invention relates generally to an expandable pull rod of the luggage, and more particularly to the arresting members of the expandable pull rod of the luggage.

2. Description of Related Art

The conventional luggage is generally provided with an expandable pull rod to facilitate the moving of the luggage on the surface by a traveler. However, the expandable pull rod of the conventional luggage is defective in design because it is not provided with means to enable the expandable pull rod to be adjusted in length with precision. In other words, the conventional luggage expandable pull rod cannot be securely located after it has been adjusted in length.

Taiwanese Patent Serial Number 90201421 also discloses arresting members of an expandable pull rod. This disclosure comprises a first arresting member, and a second arresting member which is rather complicated in construction and is therefore not cost-effective. In addition, the second arresting member is excessively long such that the overall length of the pull rod frame must be increased accordingly.

BRIEF SUMMARY OF THE INVENTION

It is the primary objective of the present invention to provide a luggage with an expandable pull rod which can be accurately adjusted in length.

It is another objective of the present invention to provide a luggage with a pull rod frame comprising a first arresting member, and a second arresting member which is simple in construction and can be economically made.

The foregoing objectives, features and functions of the present invention will be readily understood upon a thoughtful deliberation of the following detailed description of the present invention in reference to the accompanying drawings.

DETAILED DESCRIPTION OF THE INVENTION

Figure 1:
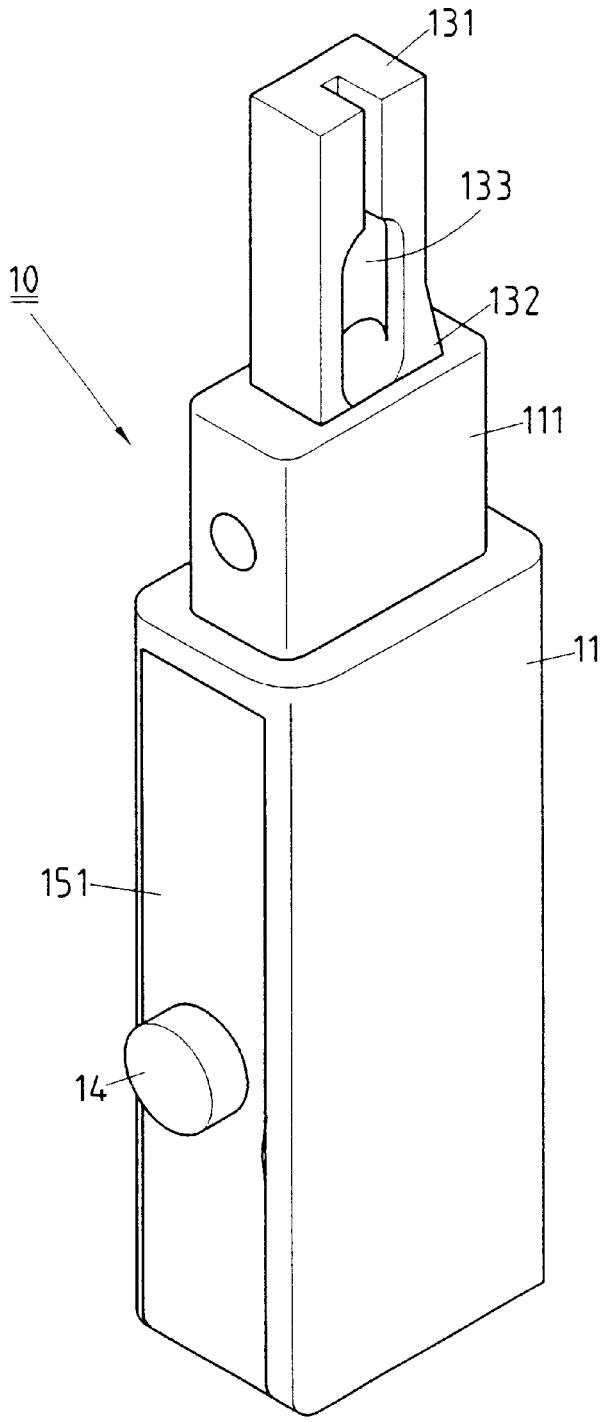
FIG. 1 shows a perspective view of the first arresting member of the present invention.

As shown in FIGS. 1–8, the present invention comprises a first arresting member 10 and a second arresting member 40, which are disposed in the interior of a tubular body of a pull rod frame of the luggage.

The first arresting member 10 comprises a housing seat 11, a spring 12, an action member 13, a locating body 14, and a locating cover 15.

Figure 2:
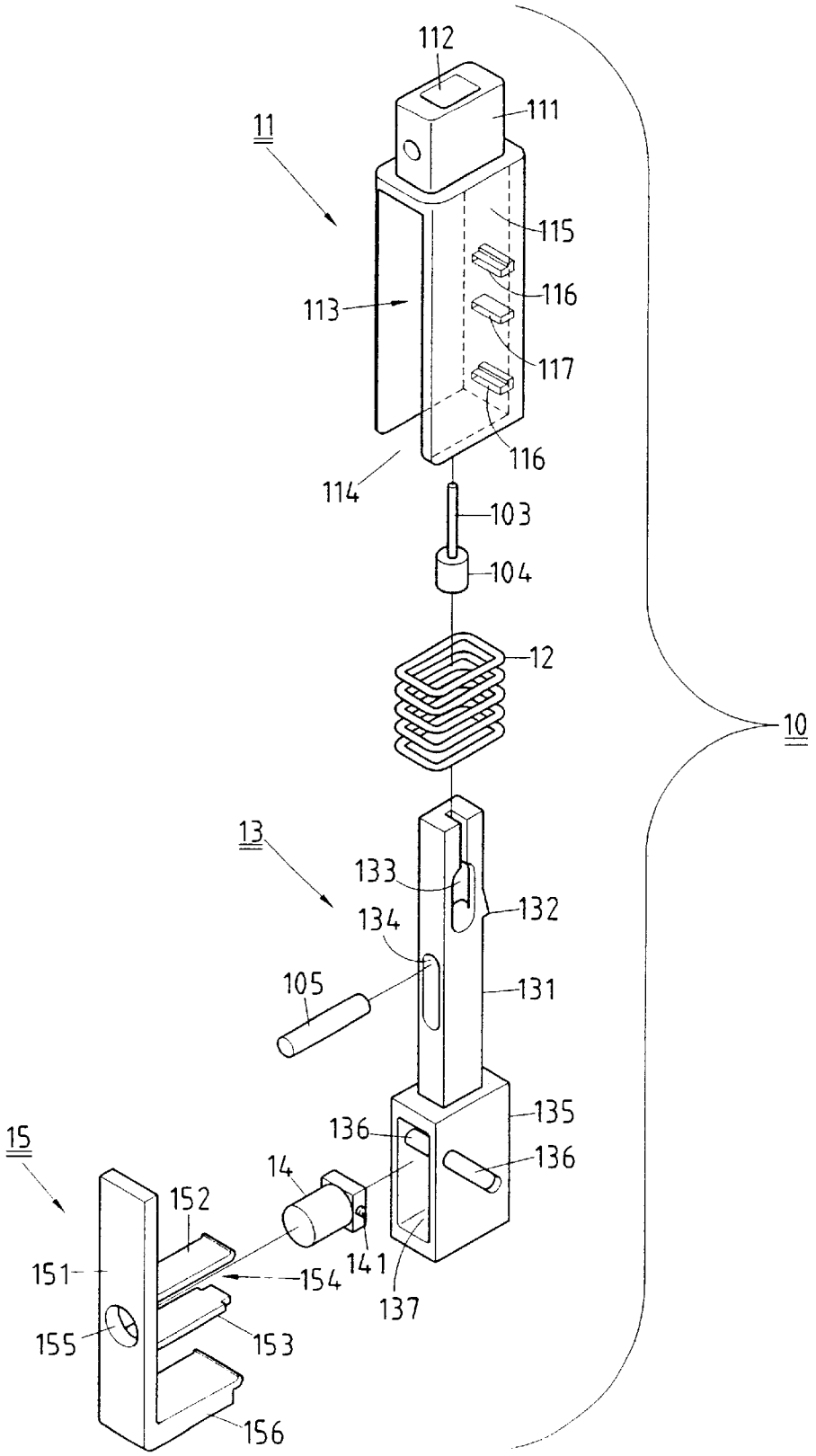
FIG. 2 shows an exploded view of the first arresting member of the present invention.
Figure 4:
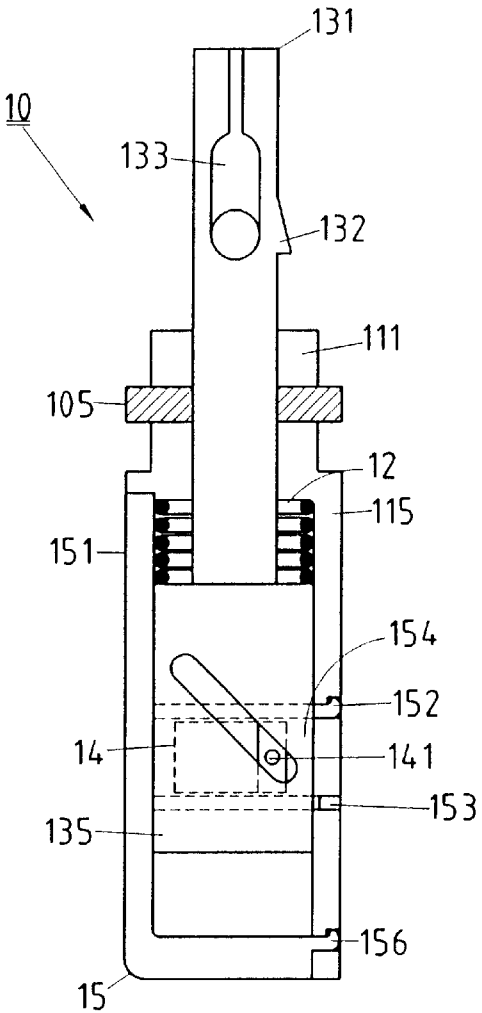
FIG. 4 shows a longitudinal sectional view of the first arresting member of the present invention in action.
Figure 3:
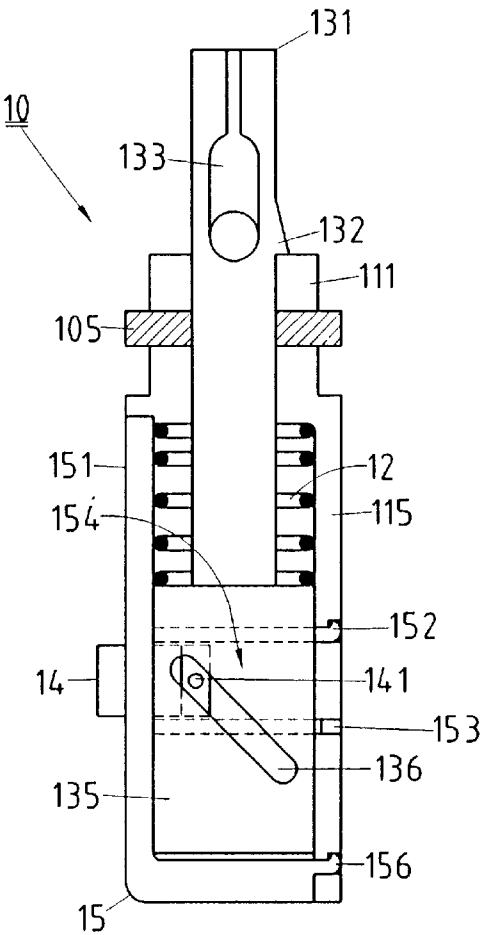
FIG. 3 shows a longitudinal sectional view of the first arresting member of the present invention.
Figure 5:
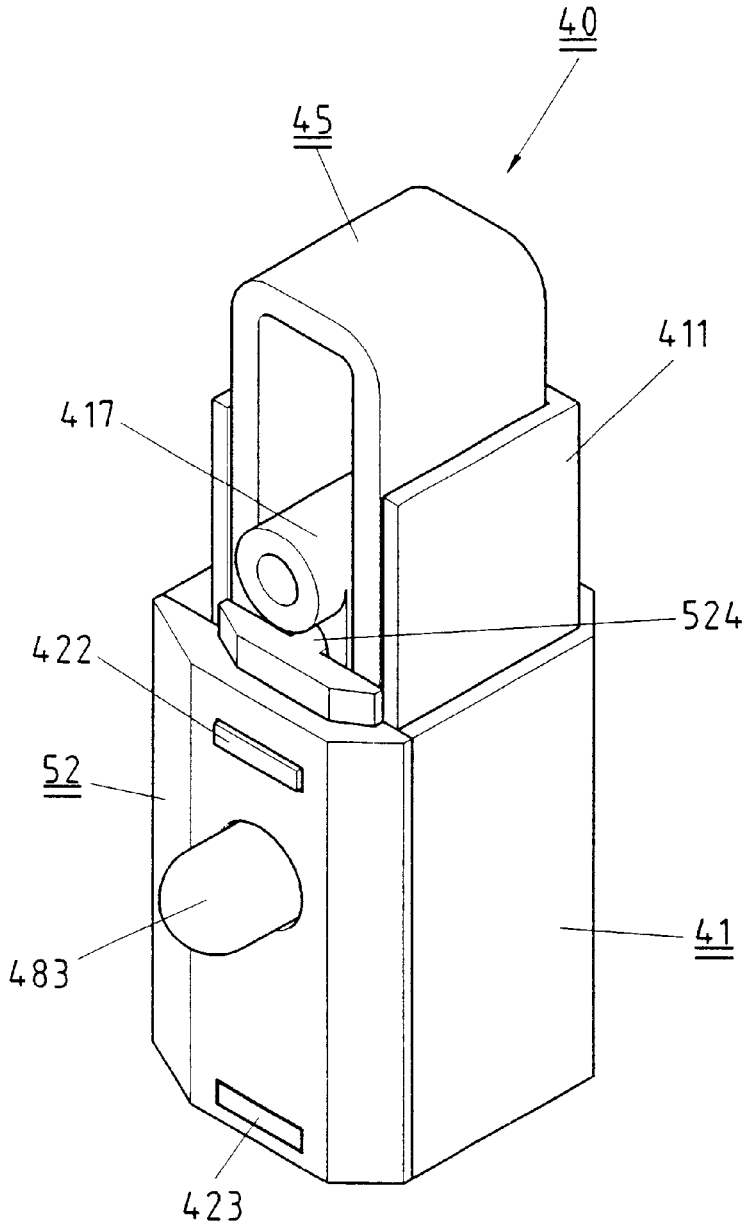
FIG. 5 shows a perspective view of the second arresting member of the present invention.
Figure 6:
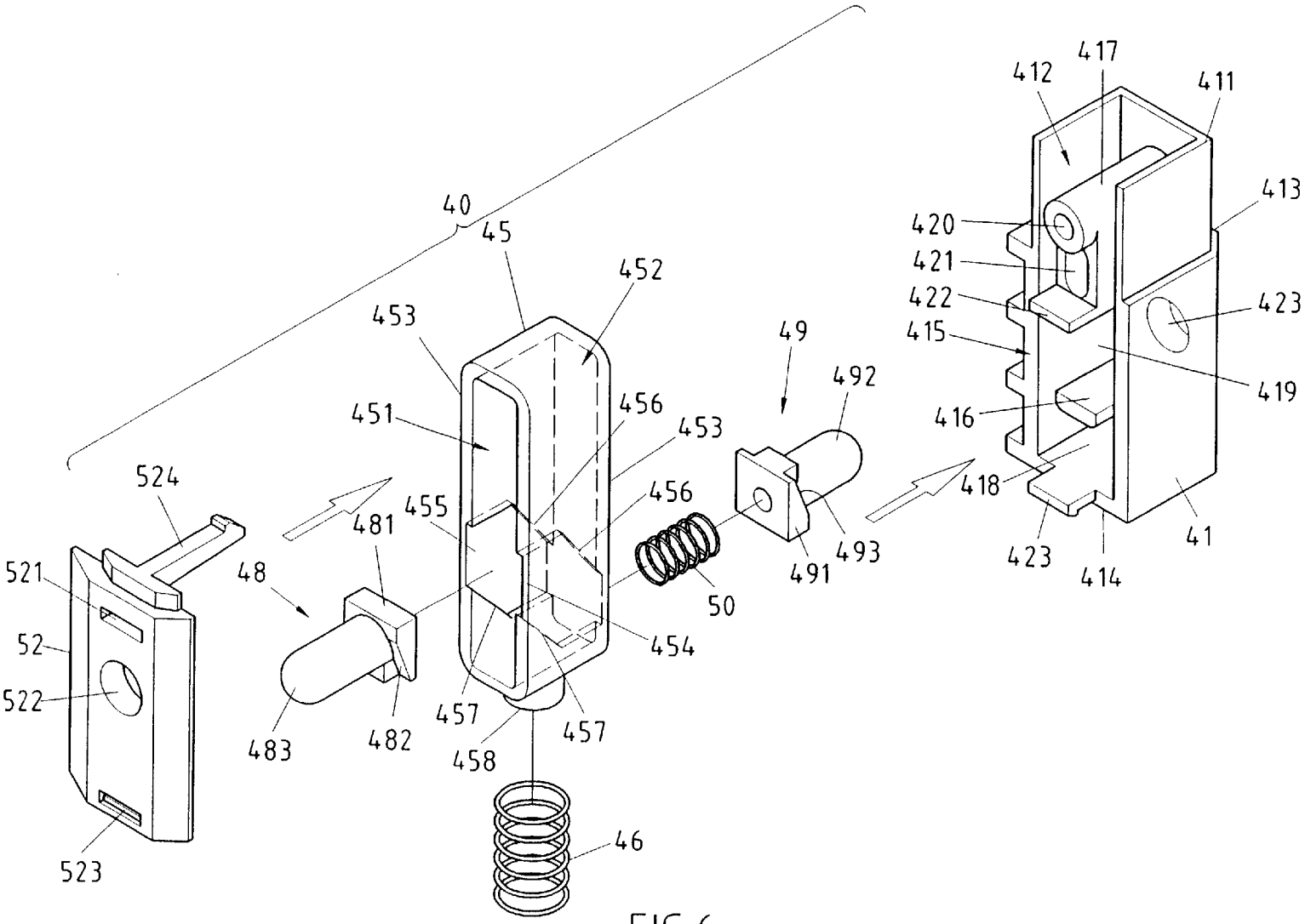
FIG. 6 shows an exploded view of the second arresting member of the present invention.
Figure 8:
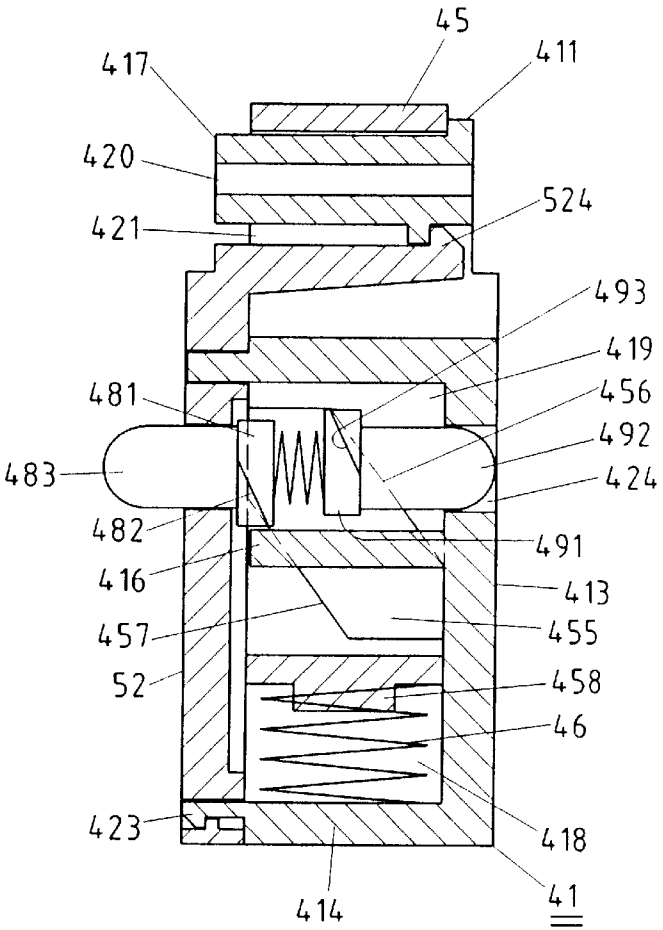
FIG. 8 shows a longitudinal sectional view of the second arresting member of the present invention at work.
Figure 7:
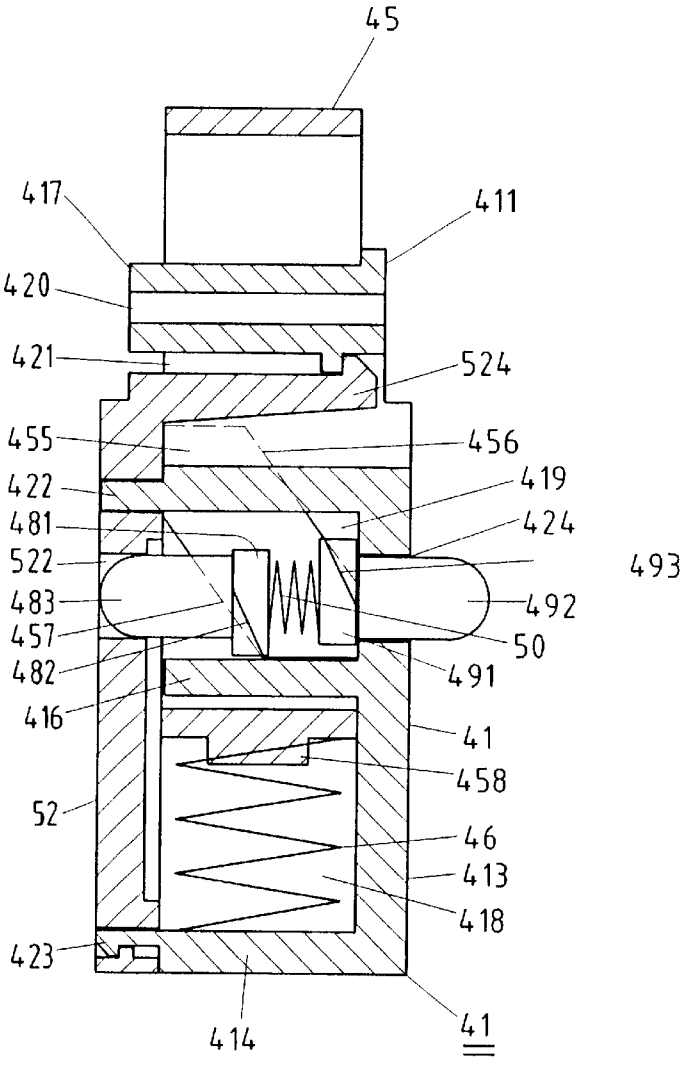
FIG. 7 shows a longitudinal sectional view of the second arresting member of the present invention in combination.
Figure 9:
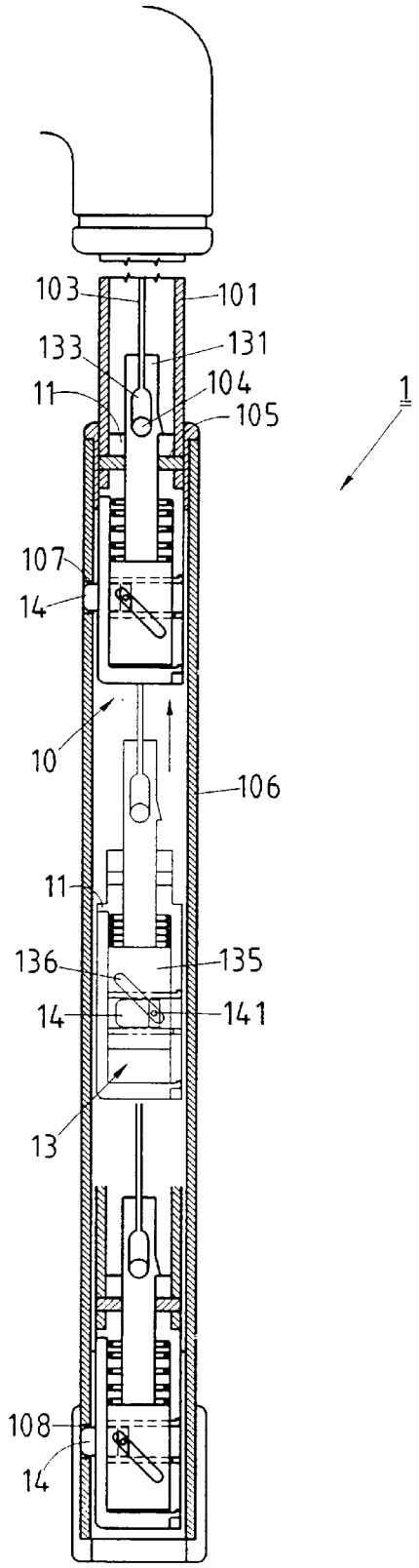
FIG. 9 shows a longitudinal sectional view of the first arresting member of the present invention in conjunction with a two-segmented pull rod frame.
Figure 10:
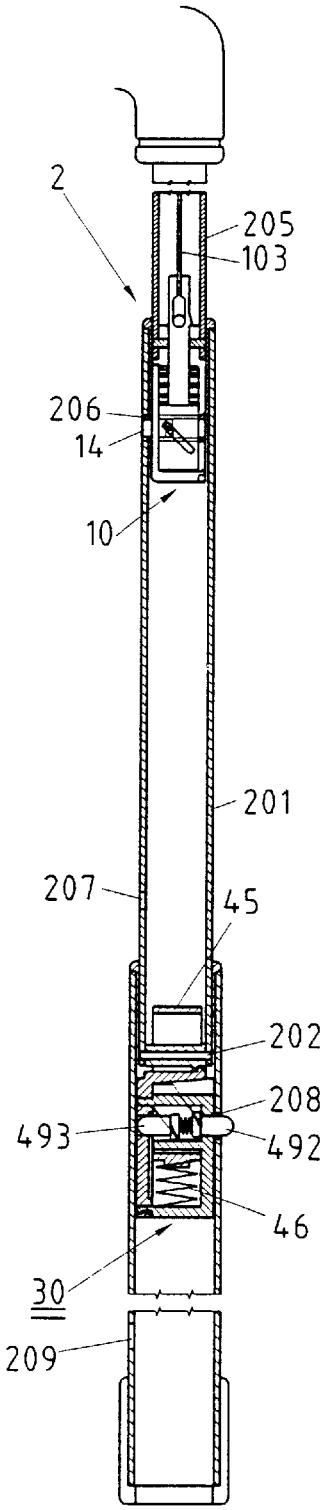
FIG. 10 shows a longitudinal sectional view of the first arresting member and the second arresting member of the present invention in conjunction with a three-segmented pull rod frame.
Figure 11:
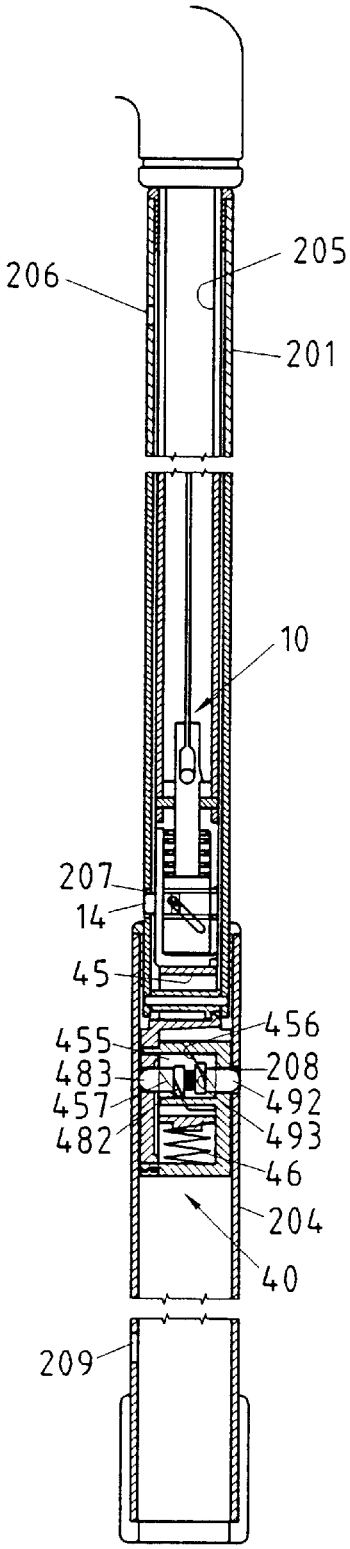
FIG. 11 shows a longitudinal sectional view of the present invention in the retraction state.
Figure 12:
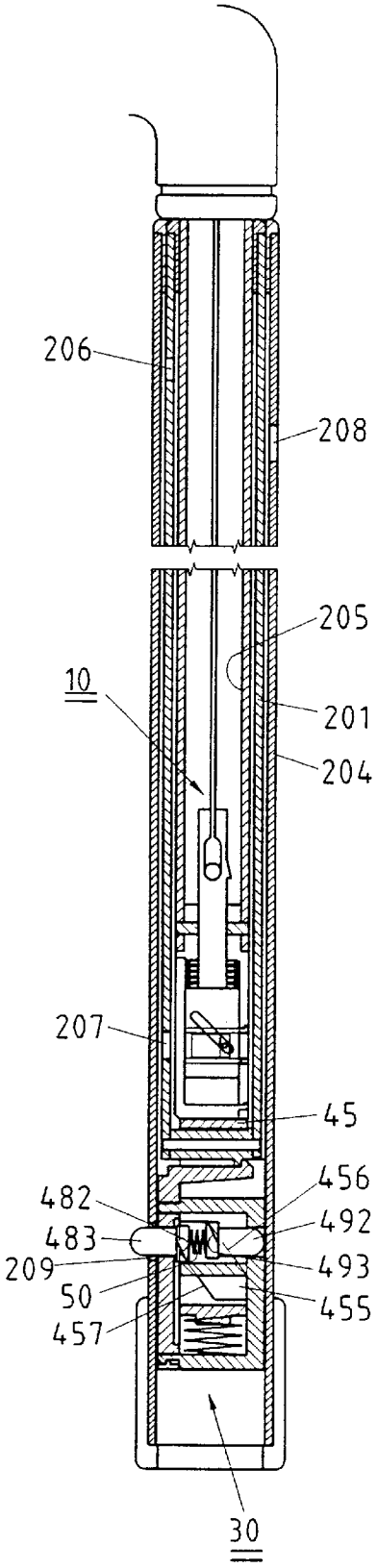
FIG. 12 shows another longitudinal sectional view of the present invention in the retraction state.

The housing seat 11 is provided in an upper end 111 with an inner diametrical hole 112, and in the interior with a receiving slot 113 in communication with the inner diametrical hole 112. The housing seat 11 is further provided at a bottom end with an opening 114. The housing seat 11 has an open longitudinal side and a closed longitudinal side 115 opposite to the open longitudinal side, as shown in FIG. 2. The closed longitudinal side 115 is provided with two retaining holes 116 and an insertion hole 117 located between the two retaining holes 116.

The spring 12 is disposed in the top portion of the receiving slot 113 of the housing seat 11.

The action member 13 is formed of a rod body 131 and a box body 135 greater in diameter than the rod body 131. The rod body 131 is provided with an inverted hook 132, a retaining slot 133, and a through hole 134. The box body 135 is dimensioned to fit into the receiving slot 113 of the housing seat 11 and is smaller in height than the receiving slot 113. The box body 135 is provided with two inclined holes 136 opposite in location to each other, and two open sides 137 opposite in location to each other. The action member 13 is joined with the housing seat 11 such that the rod body 131 is fitted into the spring 12 located at the top of the receiving slot 113, such that the inverted hook 132 and the retaining slot 133 of the rod body 131 are jut out of the upper end 111 of the housing seat 11 via the inner diametrical hole 112 of the upper end 111 of the housing seat 11, and such that the upper edge of the box body 135 of the action member 13 comes in contact with the bottom end of the spring 12.

The locating body 14 is provided at one end with two protrusions 141 and is disposed in the box body 135 of the action member 13 such that the two protrusions 141 of the locating body 14 are inserted into the two inclined holes 136 of the box body 135 of the action member 13.

The locating cover 15 is of an L-shaped construction and is formed of an upright portion 151 and a horizontal portion 156. The upright portion 151 is provided with one retaining piece 152, an insertion piece 153 separated from the retaining piece 152 by a space 154. The upright portion 151 is further provided with a through hole 155 in alignment with the space 154. The locating cover 15 is joined with the housing seat 11 such that the retaining piece 152 of the upright portion 151 of the locating cover 15 is retained in one of the two retaining holes 116 of the housing seat 11, and that the insertion piece 153 of the upright portion 151 of the locating cover 15 is inserted into the insertion hole 117 of the housing seat 11, and further that the horizontal portion 156 of the locating cover 15 is retained in other one (lower one) of the two retaining holes 116 of the housing seat 11, and further that the horizontal portion 156 of the locating cover 15 seals off the opening 114 of the bottom end of the housing seat 11, and further that the locating body 14 is confined in the space 154 which is located between the retaining piece 152 and the insertion piece 153 of the upright portion 151 of the locating cover 15. As the action member 13 is forced by the spring force of the spring 12 to move downward, the locating body 14 is guided by the inclined holes 136 of the box body 135 of the action member 13 to extend out of the locating cover 15 via the through hole 155 of the upright portion 151 of the locating cover 15.

The second arresting member 40 of the present invention comprises a housing 41, a control member 45, a first locating body 48, a second locating body 49, and a locating plate 52.

The housing 41 has an open top 411, a chamber 412 in communication with the open top 411, a closed bottom 414, a closed side 413, and an open side 415 opposite to the closed side 413. The chamber 412 is provided with a horizontal block 417, a partition 416 located under the horizontal block 417, a lower cell 418 located between the partition 416 and the closed bottom 414, and an upper cell 419 located between the partition 416 and the horizontal block 417. The horizontal block 417 is provided with an upper through hole 420 and a lower through hole 421, which are extended along the longitudinal direction of the horizontal block 417. The horizontal block 417 is provided at one end of the bottom thereof with a horizontal insertion piece 422 extending toward the open side 415 of the housing 41. The bottom edge of the open side 415 of the housing 41 is provided with an inverted hook 423 extending horizontally therefrom. The closed side 413 of the housing 41 is provided with a through hole 424 in communication with the upper cell 419.

The control member 45 has a hollow interior, two openings 451 and 452 opposite to each other, and two face plates 453 opposite to each other. The first face plate 453 is provided with a first guide slot 454, whereas the second face plate 453 is provided with a second guide slot 455. The diagonal side of the guide slots 454 and 455 form an upper guide edge 456 and a lower guide edge 457 parallel to the upper guide edge 456. The control member 45 is provided in the underside of the bottom with a projection 458 extending therefrom. The projection 458 is provided with an upright spring 46 fitted thereover. The control member 45 is disposed in the chamber 412 of the housing 41 such that the upright spring 46 is located in the lower cell 418 of the chamber 412 of the housing 41, and that the control member 45 is urged by the spring 46, thereby causing the top of the control member 45 to extend out of the open top 411 of the housing 41. As a result, the control member 45 is capable of moving up and down. The guide slots 454 and 455 of the control member 45 are located in the upper cell 419 of the housing 41.

The first locating body 48 and the second locating body 49 are respectively provided at one end thereof with a block body 481, 491. The second locating body 49 is disposed in the upper cell 419 of the housing 41 such that the block body 491 of the second locating body 49 is juts out of the housing 41 via the through hole 423 of the closed side 413 of the housing 41. The block body 491 of the second locating body 49 is provided with one inclined plane 493 in contact with the upper guide edge 456 of the control member 45. In the meantime, the block body 491 of the second locating body 49 urges one end of a horizontal spring 50. The block body 481 of the first locating body 48 is disposed in the upper cell 419 of the housing 41 such that the block body 481 of the first locating body 48 comes in contact with other end of the horizontal spring 50, and that an inclined plane 482 of the block body 481 of the first locating body 48 is in contact with the lower guide edge 457 of the control member 45.

The locating plate 52 is provided with an upper insertion hole 521 opposite to the horizontal insertion piece 422 of the housing 41, a middle through hole 522 opposite to the first locating body 48, and a lower retaining hole 523 opposite to the inverted hook 423 of the housing 41. The locating plate 52 is provided in the top with an inverted hook 524. The open side 415 of the housing 41 is sealed off by the locating plate 52 such that the inverted hook 524 of the locating plate 52 juts out of the housing 41 via the lower through hole 421 of the horizontal block 417 of the housing 41, and that the horizontal insertion piece 422 of the housing 41 is inserted into the upper insertion hole 521 of the locating plate 52, and further that the locating body end 483 of the first locating body 48 is inserted into the middle through hole 522 of the locating plate 52, and still further that the inverted hook 423 of the housing 41 is inserted into the lower retaining hole 523 of the locating plate 52. The locating body end 483 of the first locating body 48 is extended out via the middle through hole 522 of the locating plate 52.

As shown in FIGS. 2, 3, 4, and 9, the first arresting member 10 of the present invention is used in conjunction with a two-segmented pull rod frame 1. The upper end 111 of the housing seat 11 is inserted into the bottom end of the upper tube 101. A steel cable 103 is controlled by a handle switch and is provided at the bottom end with an enlarged body 104, which is retained in the retaining slot 133 of the rod body 131 of the action member 13. The first arresting member 10 is located at the bottom end of the upper tube 101 by a bolt 105 which is fastened through the horizontal hole 118 of the upper end 111 and the through hole 134 of the rod body 131 of the action member 13. The first arresting member 10 is extended into the lower tube 106. The lower tube 106 is provided with a plurality of locating holes 107, 108 for controlling the handle switch so as to enable the steel cable 103 to be pulled upward, thereby actuating the action member 13 to move up to compress the spring 12. In the meantime, the protrusions 141 of the locating body 14 are guided by the inclined holes 136 of the action member 13 to enable the locating body 14 to enter the housing seat 11. As a result, the pull rod frame 1 can be adjusted up and down.

As shown in FIGS. 3, 4, 6, 7, 8, 10, 11, and 12, the first arresting member 10 and the second arresting member 40 of the present invention are employed in conjunction with a three-segmented pull rod frame 2. The top 411 of the second arresting member 40 is put through the bottom end of the middle tube 201. The second arresting member 40 is located at the bottom end of the middle tube 201 by a bolt 202 which is fastened through the upper through hole 420 of the horizontal block 417 of the second arresting member 40. The second arresting member 40 is extended into the lower tube 204. In the meantime, the first arresting member 10 is located at the bottom end of the upper tube 205 and is extended into the top end of the middle tube 201. The middle tube 201 and the lower tube 204 are provided with a plurality of locating holes 206, 207, 208, 209 for controlling the handle switch to enable the steel cable 103 to be pulled upward, thereby causing the locating body 14 of the first arresting member 10 to move horizontally into the interior of the housing seat 11. As a result, the pull rod frame 2 can be adjusted up and down. When the upper tube 205 is slid into the middle tube 201, the bottom end of the first arresting member 10 comes in contact with the top end of the control member 45 of the second arresting member 40, thereby enabling the second locating body 49 to move away from the locating hole 208 of the lower tube 204. As a result, the middle tube 201 and the upper tube 205 are slid into the lower tube 204. The first locating body 48 is engaged with the locating hole 209 of the lower end of the lower tube 204.

Figure 13:
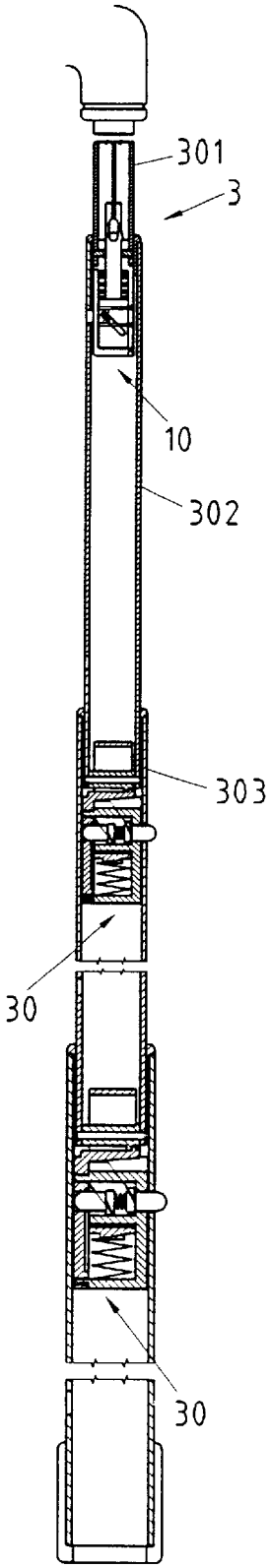
FIG. 13 shows a longitudinal sectional view of the present invention in the extraction state in conjunction with a four-segmented pull rod frame.

As shown in FIG. 13, the first arresting member 10 and the second arresting member 40 of the present invention are used in conjunction with a four-segmented pull rod frame 3 such that the first arresting member 10 is joined with the lower end of the uppermost 301, and that the second arresting member 40 is joined with the two middle tubes 302 and 303.

The present invention is versatile in design in that the first arresting member 10 and the second arresting member 40 of the present invention are adapted to a two-segmented, three-segmented, or four-segmented pull rod frame. In light of the locating body 14, the first locating body 48, and the second locating body 49 of the present invention being guided by the inclined holes 136 and the guide edges 456 and 457, the present invention works with precision. In addition, the second arresting member 40 of the present invention is relatively simple in construction and is therefore cost-effective.

I claim:

1. A pull rod frame of a luggage, said pull rod frame comprising a first arresting member and a second arresting member for adjusting the length of an expandable pull rod of the luggage;

wherein said first arresting member comprises:

a housing seat provided in an upper end with an inner diametrical hole, in an interior with a receiving slot in communication with said inner diametrical hole, and at a bottom end with an opening, said housing seat having an open longitudinal side and a closed longitudinal side opposite to said open longitudinal side, said closed longitudinal side being provided with two retaining holes and an insertion hole located between said two retaining holes;

a spring disposed in a top portion of said receiving slot of said housing seat;

an action member comprised of a rod body)and a box body greater in diameter than said rod body, said rod body being provided with an inverted hook, a retaining slot, and a through hole, said box body being dimensioned to fit into said receiving slot of said housing seat and being smaller in height than said receiving slot of said housing seat, said box body being provided with two inclined holes opposite in location to each other, and two open sides opposite in location to each other, said action member being joined with said housing seat in such a manner that said rod body is fitted into said spring, and that said inverted hook and said retaining slot of said rod body jut out of said upper end of said housing seat via said inner diametrical hole of said upper end of said housing seat, and further that an upper edge of said box body of said action member is in contact with a bottom end of said spring;

a locating body provided at one end with two protrusions and disposed in said box body of said action member such that said two protrusions of said locating body are inserted into inclined holes of said box body of said action member; and a locating cover of an L-shape construction and having an upright portion and a horizontal portion, said upright portion being provided with one retaining piece, an insertion piece separated from said retaining piece by a space, said upright portion being further provided with a through hole in alignment with said space, said locating cover being joined with said housing seat such that said retaining piece of said upright portion of said locating cover is retained in one of said two retaining holes of said housing seat, and that said insertion piece of said upright portion of said locating cover is inserted into said insertion hole of said housing seat, and further that said horizontal portion of said locating cover is retained in another one of said two retaining holes of said housing seat, and further that said horizontal portion of said locating cover seals off said opening of the bottom end of said housing seat, and further that said locating cover is confined in said space of said upright portion of said locating cover whereby said through hole of said upright portion of said locating cover serves to enable said locating body to extend out of said locating cover at such time when said action member is forced by the spring force of said spring to move downward so as to cause said locating body to be guided by said inclined holes of said box body of said action member;

wherein said second arresting member comprises:

a housing having an open top, a chamber in communication with said open top, a closed bottom, a closed side, and an open side opposite to said closed side, said chamber being provided with a horizontal block, a partition located under said horizontal block, a lower cell located between said partition and said closed bottom, and an upper cell located between said partition and said horizontal block, said horizontal block being provided with an upper through hole and a lower through hole, said horizontal block being further provided at one end of a bottom thereof with a horizontal insertion piece extending toward said open side of said housing, said open side of said housing being provided at a bottom edge with an inverted hook extending therefrom, said closed side of said housing being provided with a through hole in communication with said upper cell;

a control member having a hollow interior, two openings opposite to each other, and two face plates opposite to each other, with one of said two face plates being provided with a first guide slot, with another one of said two face plates being provided with a second guide slot, said first guide slot and said second guide slot forming an upper guide edge and a lower guide edge parallel to said upper guide edge, said control member provided in an underside of a bottom thereof with a projection extending therefrom, said projection being provided with an upright spring fitted thereover, said control member being disposed in said chamber of said housing such that said upright spring is located in said lower cell of said chamber of said housing, and that said control member is urged by said spring, thereby causing a top of said control member to extend out of said open top of said housing whereby said first guide slot and said second guide slot of said control member are located in said upper cell of said housing;

a first locating body and a second locating body, which are provided at one end thereof with a block body, said second locating body being disposed in said upper cell of said housing such that said block body of said second locating body juts out of said housing via said through hole of said closed side of said housing, said block body of said second locating body being provided with one inclined plane in contact with said upper guide edge of said control member, said block body of said second locating body urging one end of a horizontal spring, said block body of said first locating body being disposed in said upper cell of said housing such that said block body of said first locating body is in contact with said other end of said horizontal spring, and that an inclined plane of said block body of said first locating body is in contact with said lower guide edge of said control member;

a locating plate provided with an upper insertion hole opposite to said horizontal insertion piece of said housing, a middle through hole opposite to said first locating body, and a lower retaining hole opposite to said inverted hook of said housing, said locating plate being further provided in a top with an inverted hook, said open side of said housing being sealed off by said locating plate such that said inverted hook of said locating plate is juts out of said housing via said lower through hole of said horizontal block of said housing, and that said horizontal insertion piece of said housing is inserted into said upper insertion hole of said locating plate, and further that a locating body end of said first locating body is inserted into said middle through hole of said locating plate, and still further that said inverted hook of said housing is inserted into said lower retaining hole of said locating plate whereby said locating body end of said first locating body is extended out via middle through hole of said locating plate.

* * * * *